US005579534A

United States Patent [19]

Itoh et al.

[11] Patent Number: 5,579,534

[45] Date of Patent: Nov. 26, 1996

[54] HEAT-RESISTANT MEMBER

[75] Inventors: Masayuki Itoh; Kazuhiro Yasuda; Kunihiko Wada; Seiichi Suenaga; Shinji Arai, all of Kanagawa-ken, Japan

[73] Assignee: Kabushiki Kaisha Toshiba, Kanagawa-ken, Japan

[21] Appl. No.: 445,069

[22] Filed: May 19, 1995

[30] Foreign Application Priority Data

May 23, 1994 [JP] Japan ..... 6-108166

[51] Int. Cl.[6] ..... B22F 7/04

[52] U.S. Cl. ..... 428/547; 428/548; 428/551; 428/552; 428/553; 428/557; 428/908.8

[58] Field of Search ..... 428/546, 547, 428/548, 551, 552, 553, 557, 908.8

[56] References Cited

U.S. PATENT DOCUMENTS

| | | | |
|---|---|---|---|
| 2,771,969 | 11/1956 | Brownlow | 189/36.5 |
| 3,029,559 | 4/1962 | Treptow | 49/81 |
| 3,148,981 | 9/1964 | Ryshkewitch | 75/206 |
| 3,284,174 | 11/1966 | Zimmer | 29/183.5 |
| 3,573,963 | 4/1971 | Maxwell | 117/71 |
| 3,719,519 | 3/1973 | Perugini | 117/71 M |
| 3,971,633 | 7/1976 | Wolfla et al. | 29/195 |
| 3,975,165 | 8/1976 | Elbert et al. | 29/182.2 |
| 4,095,003 | 6/1978 | Weatherly et al. | 427/34 |
| 4,399,199 | 8/1983 | McGill et al. | 428/633 |
| 4,503,130 | 3/1985 | Bosshart et al. | 428/632 |
| 4,778,649 | 10/1988 | Niino et al. | 419/9 |
| 4,798,770 | 1/1989 | Donomoto et al. | 428/547 |
| 4,897,315 | 1/1990 | Gupta | 428/552 |
| 4,910,092 | 3/1990 | Olson et al. | 428/557 |
| 5,281,487 | 1/1994 | Rumaner et al. | 428/552 |
| 5,384,200 | 1/1995 | Giles et al. | 428/552 |
| 5,384,201 | 1/1995 | Finkbeiner et al. | 428/552 |
| 5,403,669 | 4/1995 | Gupta et al. | 428/550 |

FOREIGN PATENT DOCUMENTS 5-263212 10/1993 Japan .

*Primary Examiner*—Charles T. Jordan
*Assistant Examiner*—Daniel Jenkins
*Attorney, Agent, or Firm*—Finnegan, Henderson, Farabow, Garrett & Dunner, L.L.P.

[57] ABSTRACT

A heat-resistant member is constructed by having a ceramic coating layer deposited on the surface of a metallic substrate through the medium of a metallic bonding layer. The metallic bonding layer is composed of at least two layers, i.e. a layer of an aggregate of minute particles disposed on the metallic substrate side and a layer of an aggregate of coarse particles disposed on the ceramic coating layer side. Otherwise, the metallic bonding layer is composed of at least three layers, i.e. two layers of an aggregate of coarse particles disposed one each on the metallic substrate side and the ceramic coating layer side and one layer of an aggregate of minute particles interposed between these two layers of an aggregate of coarse particles. These layers are obtained by the low pressure ambient plasma thermal spraying using a fine powder or a coarse powder of an alloy resistant to corrosion and oxidation. The metallic bonding layer constructed as described above is excellent in the ability to resist high temperature oxidation and high temperature corrosion and stable to tolerate thermal fatigue and thermal impacts. Thus, it is capable of preventing the thermal barrier coating layer from sustaining cracks or inducing film separation.

20 Claims, 2 Drawing Sheets

HEAT-RESISTANT MEMBER

BACKGROUND OF THE INVENTION

1. Field of the Invention

This invention relates to a heat-resistant member which comprises a metallic substrate and a ceramic coating layer deposited thereon.

2. Description of the Related Art

The thermal barrier coating which consists in coating the surface of a metallic substrate with a varying sort of heat-resistant • refractory ceramic material is applied, for example, to heat-resistant alloy members which are used in various fields. As means for coating a metallic surface with a ceramic material, the thermal spraying method, baking method, physical vacuum deposition method, chemical vacuum deposition method, surface oxidation method, or the like have been heretofore utilized. Particularly from the viewpoint of productivity on a commercial scale, the thermal spraying method has been generally applied to the coating of a high melting material with a thick film.

Incidentally, the thermal expansion coefficient of a metallic substrate and that of a ceramic material forming a ceramic coating layer are different approximately by one decimal place. At high temperatures or in an environment of serious thermal fluctuation, thermal stress due to the difference in thermal expansion between the metallic substrate and the ceramic coating layer mentioned above arises in the interface therebetween and tends to induce such phenomena as cracking of the ceramic coating layer or separation of the layer from the substrate. Thus, the practice of interposing a metallic bonding layer as a thermal stress relaxing layer between the metallic substrate and the ceramic coating layer is prevailing.

Also for the formation of such a metallic bonding layer as mentioned above, the thermal spraying method is generally adopted. The thermal spraying method is known in two types, the atmospheric plasma spraying method and the low pressure ambient plasma method. The atmospheric plasma spraying method consists in effecting plasma spraying under the atmospheric ambience. The low pressure ambient plasma spraying method resides in effecting plasma spraying under pressure lower than the atmospheric pressure. For the formation of the metallic bonding layer, the atmospheric plasma spraying method and the low pressure ambient plasma spraying method are both utilized.

The metallic bonding layer formed by the atmospheric plasma spraying method, however, contains pores and oxides at a ratio of about several percent and exhibits a great effect in alleviating thermal stress and nevertheless is at a disadvantage in offering poor resistance to high-temperature oxidation or high-temperature corrosion. As the result of this disadvantage, the metallic substrate is deteriorated. In contrast, the metallic bonding layer produced by the low temperature ambient plasma spraying method has a dense texture and contains pores and oxides at a low ratio. While it excels in the ability to resist high temperature oxidation and high temperature corrosion, it is at a disadvantage in exhibiting only a small effect in relaxing thermal stress and betraying vulnerability to thermal fatigue and thermal impacts. As a result, the thermal barrier coating layer tends to sustain cracks and consequently entail separation and suffers from impairment of the properties which are expected of a heat-resistant member.

The conventional heat-resistant member possessing a ceramic coating layer incurs various encounters various problems as described above, depending on the kind of a metallic bonding layer to be interposed as a thermal stress relaxing layer between the metallic substrate and the ceramic coating layer. The metallic bonding layer produced by the atmospheric plasma spraying method, for example, is at a disadvantage in offering poor resistance to high temperature oxidation and high temperature corrosion. Meanwhile, the metallic bonding layer produced by the low pressure ambient plasma thermal spraying method is at a disadvantage in exhibiting only a small effect in relaxing thermal stress and betraying vulnerability to thermal fatigue and thermal impacts.

The development of a heat-resistant member which possesses a metallic bonding layer excelling in resistance to high temperature oxidation and high temperature corrosion and exhibiting stability to tolerate thermal fatigue and thermal impacts has been longed for.

SUMMARY OF THE INVENTION

An object of this invention, therefore, is to provide a heat-resistant member which, owing to the use of a metallic bonding layer excellent in resistance to high temperature oxidation and high temperature corrosion and stable to tolerate thermal fatigue and thermal impacts, is enabled to prevent effectively the thermal barrier coating layer from sustaining cracks and consequently inducing separation and the metallic substrate from deterioration.

The first heat-resistant member contemplated by this invention is characterized by comprising a metallic substrate, a ceramic coating layer covering the surface of the metallic substrate, and a metallic bonding layer interposed between the metallic substrate and the ceramic coating layer and possessed of at least a layer of an aggregate of minute particles disposed on the metallic substrate side and a layer of an aggregate of coarse particles disposed on the ceramic coating layer side.

The second heat-resistant member is characterized by comprising a metallic substrate, a ceramic coating layer covering the surface of the metallic substrate, and a metallic bonding layer interposed between the metallic substrate and the ceramic coating layer and possessed of at least a layer of an aggregate of first coarse particles disposed on the metallic substrate side, a layer of an aggregate of second coarse particles disposed on the ceramic coating layer side, and a layer of an aggregate of minute coarse particles disposed between the layer of the aggregate of the first coarse particles and the layer of the aggregate of the second coarse particles.

In the first heat-resistant member of the present invention, the metallic bonding layer formed between the metallic substrate and the ceramic coating layer is composed of at least two layers, i.e. the layer of the aggregate of minute particles disposed on the metallic substrate side and the layer of the aggregate of coarse particles disposed on the ceramic coating layer side. The heat-resistant member, therefore, produces highly desirable adhesive force between the ceramic coating layer and the metallic bonding layer and attains effective relaxation of thermal stress and, moreover, allows the metallic bonding layer to manifest exalted resistance to high temperature oxidation and high temperature corrosion. In other words, the thermal barrier coating layer can be prevented from sustaining cracks and consequently inducing layer separation. As a result, the metallic substrate can be prevented stably from deterioration due to oxidation and corrosion.

Then, in the second heat-resistant member, since the aggregate of coarse particles is additionally disposed on the metallic substrate side, the adhesive force between the metallic substrate and the metallic bonding layer and the effective relaxation of thermal stress can be further exalted.

DESCRIPTION OF THE PREFERRED EMBODIMENTS

Now, this invention will be described more specifically below with reference to working examples.

Figure 1:
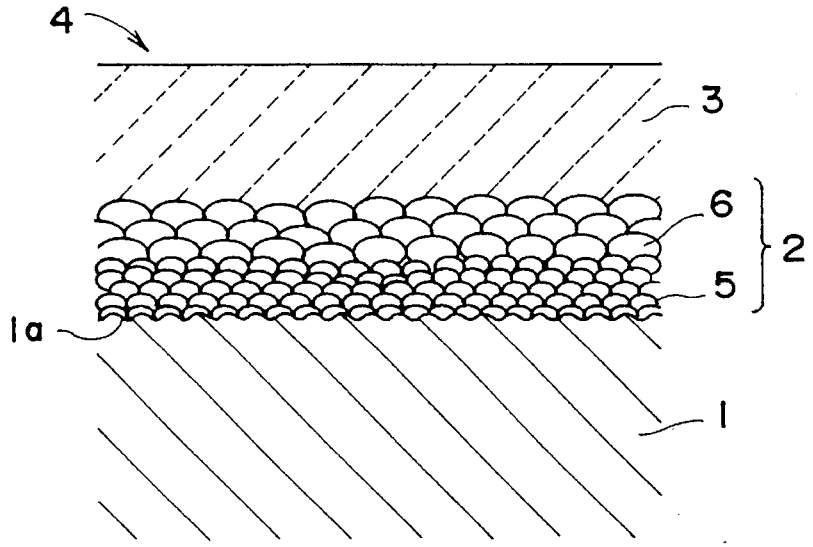
FIG. 1 is a cross section showing by means of a model the construction of the embodiment of the first heat-resistant member of this invention.

FIG. 1 is a cross section showing by means of a model the construction of one example of the first heat-resistant member of this invention. In the diagram, 1 stands for a metallic substrate. For the metallic substrate 1, various metallic materials such as, for example, heat-resistant alloys which are now in general use can be used, depending on the purpose for which the metallic substrate 1 is used. To be specific, a heat-resistant alloy having at least one element selected from among Ni, Co, and Fe as a main component thereof may be cited. Where the metallic substrate is used under a particularly harsh thermal environment, it is effective to use such Ni-based heat-resistant alloys as IN738, Mar-M247, and IN939 and such Co-based heat-resistant alloys as FSX-414, HS-188, and MM509. A surface 1*a* of the metallic substrate 1 is desired to be coarsened preparatorily by the sand blast treatment using alumina grits.

The surface 1*a* of the metallic substrate 1 is covered with a ceramic coating layer 3 disposed thereon through the medium of a metallic bonding layer 2. These layers jointly form a heat-resistant member 4. For the ceramic coating layer 2, various kinds of heat-resistant ceramic materials can be used. The heat-resistant ceramic materials which are usable herein include partially stabilized $ZrO_2$, SiC, $Si_3N_4$, WC, TiC, $TiO_2$, $Al_2O_3$, CaO, $SiO_2$, CaO-$SiO_2$ series, CaO-$Al_2O_3$ series, and CaO-$P_2O_5$ series, for example. In these heat-resistant ceramic materials, the partially stabilized $ZrO_2$ and especially the Y-stabilized $ZrO_2$ which have small degrees of thermal conductivity and large thermal expansion coefficients, namely such thermal expansion coefficient as approximate those of metallic materials, prove particularly effective. As the stabilizing component for the partially stabilized $ZrO_2$, MgO, CaO, $CeO_2$, etc. can be used besides $Y_2O_3$.

The ceramic coating layer 3 is desired to be formed in a thickness in the approximate range of from 50 to 500 μm. For the formation of this layer, the thermal spraying methods including the atmospheric plasma thermal spraying method and the low pressure ambient plasma thermal spraying method, the PVD method, and the CVD method can be used. From the practical point of view, it is particularly desirable to use the thermal spraying methods, especially the atmospheric plasma thermal spraying method. The ceramic coating layer 3 thus formed exhibits enhanced adhesive force to the metallic bonding layer 2 and adds to the prominence of the effect of this invention.

The metallic bonding layer 2 which is interposed between the metallic substrate 1 and the ceramic coating layer 2 comprises a layer 5 of an aggregate of minute particles disposed on the metallic substrate 1 side and a layer 6 of an aggregate of coarse particles disposed on the ceramic coating layer 3 side.

The material for forming the metallic bonding layer 2 is desired to excel in resistance to high temperature oxidation and high temperature corrosion and, at the same time, exhibit the ability to moderate the difference in thermal expansion between the metallic substrate 1 and the ceramic coating layer 3. More specifically, it is desired to be a material possessing an intermediate thermal expansion coefficient or a highly ductile material. For example, M—Cr—Al—Y alloys (wherein M stands for at least one element selected from among Ni, Co, and Fe) may be cited as materials which answer the description.

As respects the desirable formulation of the M—Cr—Al—Y alloy, a composition of 1 to 20% by weight of Al, 10 to 35% by weight of Cr, 0.1 to 1.5% by weight of Y, and the balance substantially of the M element may be cited. Al and Cr are elements which both contribute to enhance the resistance of the alloy to oxidation and corrosion. When the ratios of these elements fall within the respective ranges mentioned above, they enable the alloy to acquire a sufficient ability to resist corrosion and oxidation. Preferably, the ratio of Al is in the range of from 5 to 15% by weight and that of Cr in the range of from 15 to 30% by weight, Y is an element intended to reinforce a protective oxide coating and maintain the strength thereof. When the ratio of Y is in the range mentioned above, the effect thereof mentioned above can be fully manifested in the alloy. Preferably, the ratio of Y is in the range of from 0.3 to 1% by weight.

In the metallic bonding layer 2, the layer 5 of the aggregate of minute particles disposed on the metallic substrate 1 side is obtained by preparing a fine powder having an average particle diameter in the range of from 1 to 44 μm from the material for forming the metallic bonding layer 2 as mentioned above and subjecting the fine powder to plasma thermal spraying. By the plasma thermal spraying of such a fine powder as mentioned above, a layer of an aggregate of particles (component particles) having practically the same particle diameter as the starting material powder. Thus, the layer 5 of the aggregate of minute particles is obtained.

The layer 5 of the aggregate of minute particles having such an average particle diameter as mentioned above is dense in texture and functions mainly to impart to the alloy the ability to resist high temperature oxidation and high temperature corrosion. If the average particle diameter of the particles forming the layer 5 of the aggregate of minute particles is not more than 1 μm, the layer 5 of the aggregate conspicuously will gain in density of texture, suffer a decline in such properties as resistance to thermal impacts and thermal fatigue, and go to impair productivity. Conversely, if the average particle diameter exceeds 44 μm, the heat-resistant member will fail to acquire highly satisfactory resistance to high temperature oxidation and high temperature corrosion because such defects as pores will increase.

Figure 2:
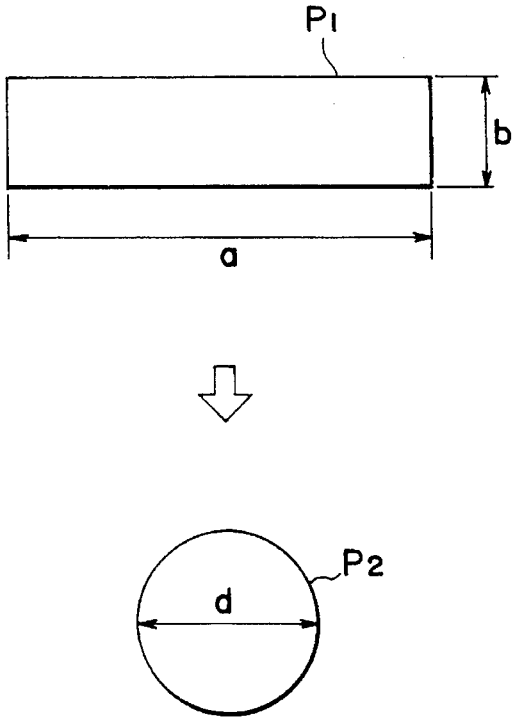
FIG. 2 is a diagram as an aid in the explanation of the reduced particle diameter of particles forming a layer of an aggregate.

When the plasma flame spray is used in this case, the particles forming the layer 5 of the aggregate of minute particles more often than not assume a shape crushed in the direction of thermal spraying (the direction of thickness of the layer). The expression "particle diameter of these flattened particles" as used herein is to be construed as referring to the diameter d which results from reducing a flattened particle $P_1$ to a spherical particle $P_2$ as shown in FIG. 2. To be specific, in a cross section of the layer 5 of the aggregate, the largest length of the flattened particle $P_1$ in the direction perpendicular to the direction of thickness of the layer 5 of the aggregate is represented as a and the largest length in the direction of thickness as b. The flattened particle $P_1$ is approximated with a circular cylinder having a cross section of the length a and the length b and the volume of the circular cylinder is calculated. The diameter d of the spherical particle $P_2$ whose volume equals the volume of the circular cylinder is reported as the reduced particle diameter of the flattened particle $P_1$. The average particle diameter of the component particles of the layer 5 of the aggregate of minute particles mentioned above is the value calculated from the reduced particle diameter d. The same remarks hold good for the layer 6 of the aggregate of coarse particles.

The fine powder which is used in the formation of the layer 5 of the aggregate of minute particles by the plasma thermal spraying is desired to have an average particle diameter of the foregoing definition in the range of from 1 to 44 μm and contain particles of diameters falling within the average particle diameter±10 μm at a ratio of at least 70% by volume. If the particle size distribution of the powder is unduly wide, the effects mentioned above will not be obtained in all likelihood with high repeatability. More desirably, the powder to be used in the formation of the layer 5 of the aggregate of minute particles contain particles of diameters falling within the average particle diameter±10 μm at a ratio of at least 80% by volume.

The layer 5 of the aggregate of minute particles is desired to be formed in a thickness in the approximate range of from 30 to 200 μm. If the thickness of the layer 5 of the aggregate of minute particles is less than 30 μm, the possibility arises that the heat-resistant member will be incapable of acquiring fully satisfactory resistance to high temperature oxidation and high temperature corrosion. Conversely, if this thickness exceeds 200 μm, the possibility arises that unduly large thermal stress will develop in the layer 5 of the aggregate and induce layer separation. The surface roughness of the layer 5 of the aggregate of minute particles is desired to be such that a maximum height $R_{max}$ of irregularities falls in the range of from 30 to 45 μm and a ten point average height $R_z$ if irregularities in the range of from 25 to 35 μm. When the heights fall in these ranges, the layer 5 of the aggregate of minute particles manifests its functions to better advantage.

In the metallic bonding layer 2, the layer 6 of the aggregate of coarse particles disposed on the ceramic coating layer 3 side is obtained by preparing a coarse powder having an average particle diameter in the range of from 45 to 300 μm from an alloy resistant to corrosion and oxidation as mentioned above and subjecting the powder to plasma thermal spraying. By the plasma thermal spraying of the coarse powder, the layer of the aggregate of particles (component particles) having practically the same particle diameter as the starting material powder. Thus, the layer 6 of the aggregate of coarse particles is obtained.

The layer 6 of the aggregate of such coarse particles as are mentioned above manifests an excellent effect of relaxing the thermal stress which develops in the interface between the metallic bonding layer 2 and the ceramic coating layer 3. Further, since it assumes large surface roughness, it manifests an anchoring effect to the ceramic coating layer 3 and contributes to enhance the tight adhesive force between the metallic bonding layer 2 and the ceramic coating layer 3. As a result, the otherwise possible separation of the ceramic coating layer 3 is prevented. If the average particle diameter of the component particles of the layer 6 of the aggregate of coarse particles is less than 45 μm, the effect of relaxing the thermal stress and the anchoring effect mentioned above will not be fully manifested. If this average particle diameter exceeds 300 μm, the possibility arises that the defects persisting in the layer will seriously impair the resistance to corrosion and oxidation and the defects will interconnect to give rise to cracks and induce film separation.

The coarse powder to be used in the formation of the layer 6 of the aggregate of coarse particles by the plasma thermal spraying is desired to have an average particle diameter in the range of from 45 to 300 μm and, at the same time, contain particles of diameters falling within the average particle diameter±20 μm at a ratio of at least 70% by volume. If the particle size distribution of the powder is unduly wide, the possibility arises that the effects mentioned above will not be obtained with high repeatability. More desirably, the coarse powder to be used in the formation of the layer 6 of the aggregate of coarse particles contain particles of diameters falling within the average particle diameter±20 μm at a ratio of at least 80% by volume.

The layer 6 of the aggregate of coarse particles is desired to be formed in a thickness in the approximate range of from 30 to 300 μm. If the thickness of the layer 6 of the aggregate of coarse particles is less than 30 μm, the possibility arises that the effect of relaxing the thermal stress will not be fully obtained. Conversely, if this thickness exceeds 300 μm, the possibility arises that the thermal stress developed inside the layer 6 of the aggregate will grow and consequently induce film separation. Further, the surface roughness of the layer 6 of the aggregate of coarse particles is desired to be such that a maximum height $R_{max}$ of irregularities falls in the range of from 75 to 10 μm and a ten point average height $R_z$ of irregularities in the range of from 56 to 70 μm. When the heights fall in the respective ranges mentioned above, the layer 6 of the aggregate of coarse particles will manifest the effect of relaxing the thermal stress and the anchoring effect to better advantage.

The heat-resistant member 4 according to the present embodiment exhibits a highly desirable effect of relaxing the thermal stress and produces high adhesive force between the ceramic coating layer 3 and the metallic bonding layer 2 and, moreover, manifests exalted resistance to high temperature oxidation and high temperature corrosion because the metallic bonding layer 2 is composed of the layer 5 of the aggregate of minute particles disposed on the metallic substrate 1 side and the layer 6 of the aggregate of coarse particles disposed on the ceramic coating layer 3 side. As a result, the metallic bonding layer 2 can be prevented from sustaining cracks and consequently inducing film separation and the metallic substrate 1 can be stably prevented from being deteriorated by oxidation and corrosion.

The embodiment described above represents a case of using the metallic bonding layer 2 which comprises the layer 5 of the aggregate of minute particles disposed on the metallic substrate 1 side and the layer 6 of the aggregate of coarse particles disposed on the ceramic coating layer 3 side. The first heat-resistant member of this invention is not limited to this particular embodiment. Optionally, a layer of a mixed aggregate of minute particles and coarse particles may be interposed between the layer 5 of the aggregate of minute particles and the layer 6 of the aggregate of coarse particles. By the incorporation of the layer of the mixed aggregate, the adhesiveness between the layer 5 of the aggregate of minute particles and the layer 6 of the aggregate of coarse particles, and the thermal stress relaxation can be improved.

The minute particles and the coarse particles to be used for the layer of the mixed aggregate conform, with necessary modifications, to the component particles for the layer 5 of the aggregate of minute particles and the layer 6 of the aggregate of coarse particles. To be specific, the layer of the mixed aggregate of minute particles and coarse particles can be formed by preparing a mixed powder of a powder of minute particles used for the formation of the layer 5 of the aggregate of minute particles and a powder of coarse particles used for the formation of the layer 6 of the aggregate of coarse particles and subjecting this mixed powder to plasma thermal spraying.

The layer of the mixed aggregate of minute particles and coarse particles may be formed with the mixing ratio of minute particles and coarse particles fixed or with this mixing ratio changed continuously or stepwise. When the mixing ratio of minute particles and coarse particles is changed, this change is desired to be made so that the ratio of minute particles is high on the side of the layer 5 of the aggregate of minute particles and the ratio of coarse particles is high on the side of the layer 6 of the aggregate of coarse particles. The layer of the mixed aggregate which has the mixing ratio changed as described above can be formed by continuously or stepwise changing the mixing ratio of the powder of minute particles and the powder of coarse particles during the plasma thermal spraying operation. The formation of the layer of the mixed aggregate having the mixing ratio changed as described above brings about additional improvements of the effect of relaxing the thermal stress between the metallic substrate and the ceramic coating layer.

The thickness of the metallic bonding layer 2 in its entirety is desired to be in the range of from 50 to 400 μm, inclusive of the case of additionally forming the layer of the mixed aggregate mentioned above. If the thickness of the metallic bonding layer 2 is less than 50 μm, the possibility arises that the effect of relaxing the thermal stress and the anchoring effect will be lowered and the ability to resist corrosion and oxidation will be impaired. Conversely, if this thickness exceeds 400 μm, the possibility arises that film separation will occur. Further, the layer 5 of the aggregate of minute particles, the layer 6 of the aggregate of coarse particles, and the layer of the mixed aggregate which jointly form the metallic bonding layer 2 are desired to be formed invariably by the low pressure ambient plasma thermal spraying method. By the use of the low pressure ambient plasma thermal spraying method, the resistance to high temperature oxidation, the resistance to high temperature corrosion, and the tight adhesiveness can be further improved.

Now, the embodiment of the second heat-resistant member of this invention will be described below with reference to FIG. 3.

Figure 3:
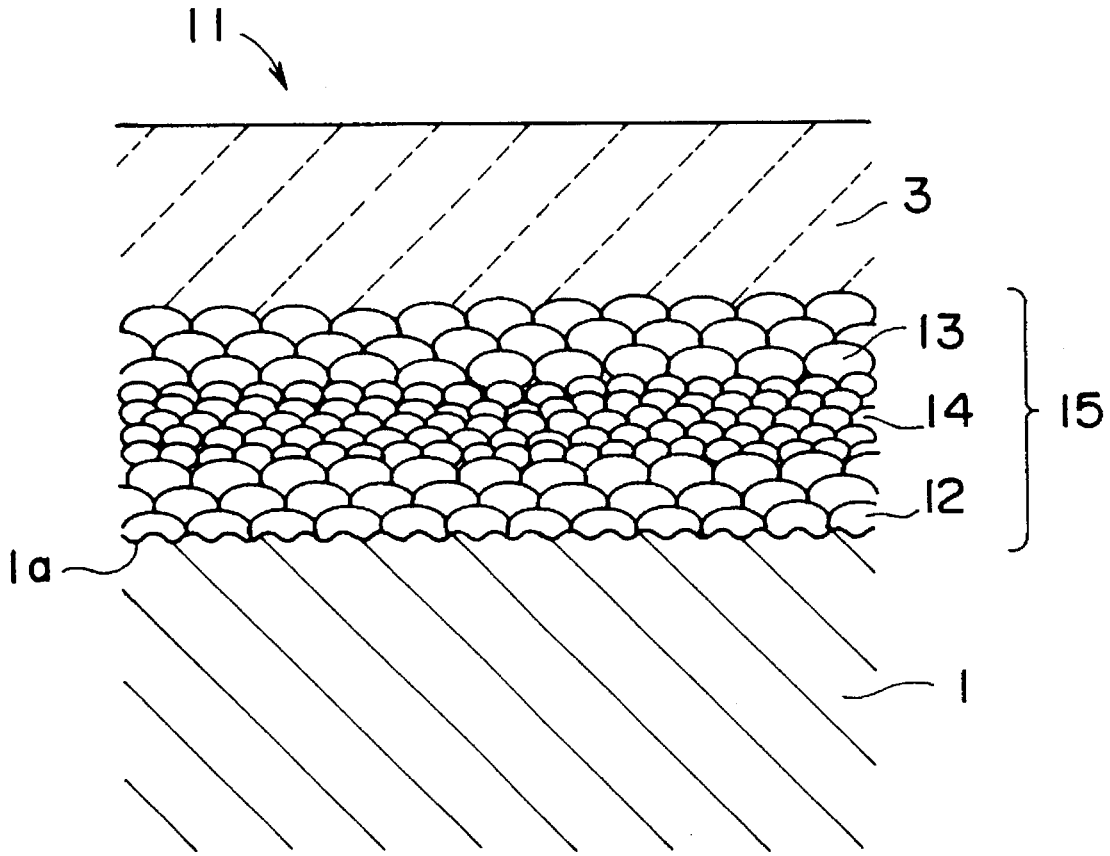
FIG. 3 is a cross section showing by means of a model the construction of the embodiment of the second heat-resistant member of this invention.

A heat-resistant member 11 shown in FIG. 3 is provided between a metallic substrate 1 and a ceramic coating layer 3 with a metallic bonding layer 15 which comprises a first layer 12 of an aggregate of coarse particles disposed on the metallic substrate 1 side, a second layer 13 of an aggregate of coarse particles disposed on the ceramic coating layer 3 side, and a layer 14 of an aggregate of minute particles disposed between the layers 12 and 13 of aggregates of coarse particles. In other words, this heat-resistant member 11 possesses the metallic bonding layer 15 of a three-layer construction which equals the metallic bonding layer 2 of the heat-resistant member 4 according to the first embodiment mentioned above plus the layer 12 of the aggregate of coarse particles disposed on the metallic substrate 1 side.

The second layer 13 of the aggregate of coarse particles disposed on the ceramic coating layer 3 side and the layer 14 of the aggregate of minute particles disposed between the layers 12, 13 of the aggregates of coarse particles are constructed in the same manner as the layer 6 of the aggregate of coarse particles and the layer 5 of the aggregate of minute particles in the first embodiment. The same remarks hold good for the metallic substrate 1 and the ceramic coating layer 3.

The first layer 12 of the aggregate of coarse particles disposed on the metallic substrate 1 side is obtained by preparing a powder of coarse particles of an alloy resistant to corrosion and oxidation and subjecting this powder to plasma thermal spraying similarly to the layer 6 of the aggregate of coarse particles in the first embodiment described above. The component particles used therefor are likewise desired to have an average particle diameter in the approximate range of from 45 to 300 μm. The thickness of the first layer 12 is likewise desired to have a thickness in the approximate range of from 30 to 300 μm. By having the layer 12 of the aggregate of such coarse particles as mentioned above disposed additionally on the metallic substrate 1 side, the effect of relaxing the thermal stress and the adhesive force between the metallic substrate 1 and the metallic bonding layer 15 can be improved further.

The embodiment described above represents a case of using the metallic bonding layer 15 which comprises the first layer 12 of the aggregate of coarse particles, the second layer 13 of the aggregate of coarse particles, and the layer 14 of the aggregate of minute particles disposed between the layers 12 and 13 of the aggregates of coarse particles. The second heat-resistant member of this invention does not need to be limited to this particular construction. It is allowed, similarly to the first embodiment described above, to have layers of a mixed aggregate of minute particles and coarse particles interposed one each between the first layer 12 of the aggregate of coarse particles and the layer 14 of the aggregate of minute particles.

The construction of the layer of the mixed aggregate is identical to that in the first embodiment described above. To be specific, the layer of the mixed aggregate of minute particles and coarse particles may be formed with the mixing ratio of minute particles and coarse particles either fixed or varied continuously or stepwise. When the mixing ratio of minute particles and coarse particles is varied, this variation is desired to be made so that the ratio of coarse particles is high on the sides of the layers 12 and 13 of the aggregates of coarse particles and the ratio of minute particles is high on the side of the layer 14 of the aggregate of minute particles.

The thickness of the metallic bonding layer 15 in its entirety is desired to be in the range of from 50 to 400 μm, inclusive of the case of forming the layer of the mixed aggregate mentioned above. If the thickness of the metallic bonding layer 15 is less than 50 μm, the possibility arises that the effect of relaxing the thermal stress and the anchoring effect will be lowered and the ability to resist corrosion and oxidation will be impaired. Conversely, if this thickness exceeds 400 μm, the possibility arises that the film separation will readily occur. Further, the first layer 12 and the second layer 13 of aggregates of coarse particles and the layer 14 of the aggregate of minute particles which jointly form the metallic bonding layer 15 and the layer of the mixed aggregate are invariably desired to be formed by the low pressure ambient plasma thermal spraying method similarly to the relevant layers of the first embodiment.

Now, concrete examples of the heat-resistant members according to the first and the second embodiments described above and the results of their rating will be explained below.

EXAMPLE 1

A plate of Ni-based heat-resistant alloy IN738 measuring 30 mm×50 mm×5 mm was prepared as the metallic substrate. First, the surface 1*a* of this metallic substrate 1 was subjected to a sand blast treatment using alumina particles of an approximate particle diameter of 1 mm as shown in FIG. 1.

Then, on the coarsened surface 1*a* of the metallic substrate 1, a fine alloy powder having a composition of Ni-23% Co-17% Cr-12% Al-0.5% Y (weight %), an average particle diameter of 25 μm, and containing particles of diameters falling within the average particle diameter±10 μm at a ratio of 80% by volume was deposited by low pressure ambient plasma thermal spraying to form a layer 5 of an aggregate of minute particles in a thickness of about 150 μm. The component particles of the layer 5 of the aggregate of minute particles had a flat shape. By the reduction of particle diameter mentioned above, these flat particles were confirmed to have a practically same average particle diameter as the average particle diameter of the fine alloy powder used as the starting material. The thermal spraying was carried out under the conditions of $6.5\times10^3$ Pa of argon gas ambient pressure, 400 mm of thermal spraying distance, and 34 V 800 A of thermal spraying output.

Subsequently, on the layer 5 of the aggregate of minute particles, a coarse alloy powder having the same composition and an average particle diameter of 150 μm, and containing particles of diameters falling within the average particle diameter±10 μm at a ratio of 73% by volume was deposited by low pressure ambient plasma thermal spraying to form a layer 6 of an aggregate of coarse particles in a thickness of about 150 μm. The thermal spraying was carried out under the conditions of $6.5\times10^3$ Pa of argon gas ambient pressure, 400 mm of thermal spraying distance, and 36 V 900 A of thermal spraying output. The component particles of the layer 6 of the aggregate of coarse particles were confirmed to have a reduced particle diameter practically equal to the average particle diameter of the coarse alloy powder used as the starting material.

The layer 5 of the aggregate of minute particles and the layer 6 of the aggregate of coarse particles jointly formed the metallic bonding layer 2 of two-layer construction. Then, on the layer 6 of the aggregate of coarse particles, a zirconia powder having a composition of 8 wt % $Y_2O_3$-$ZrO_2$ was deposited by atmospheric plasma thermal spraying under the conditions of 125 mm of thermal spraying distance, 35 V 850 A of thermal spraying output to form a ceramic coating layer 3 of Y-stabilized $ZrO_2$ having a thickness of about 300 μm.

The heat-resistant member 4 aimed at was obtained as described above. This heat-resistant member 4 was tested for such properties as will be specifically mentioned hereinbelow. The cross section of the heat-resistant member 4 was observed to draw section curves of the interface between the layer 5 of the aggregate of minute particles and the layer 6 of the aggregate of coarse particles and the interface between the layer 6 of the aggregate of coarse particles and the ceramic coating layer 3. From these section curves, $R_{max}$ and $R_z$ were determined by the method specified by JIS B 0601 (1982). As a result, the interface between the layer 5 of the aggregate of minute particles and the layer 6 of the aggregate of coarse particles was found to have 32 μm for $R_{max}$ and 28 μm for $R_z$. The interface between the layer 6 of the aggregate of coarse particles and the ceramic coating layer 3 was found to have 95 μm for $R_{max}$ and 68 μm for $R_z$.

EXAMPLE 2

A plate of Ni-based heat-resistant alloy IN738 measuring 30 mm×50 mm×5 mm was prepared as the metallic substrate. First, the surface 1*a* of this metallic substrate 1 was subjected to a sand blast treatment using alumina particles of an approximate particle diameter of 1 mm as shown in FIG. 2.

Then, on the coarsened surface 1 of the metallic substrate 1, a fine alloy powder having a composition of Ni-23% Co-17% Cr-12% Al-0.5% Y (weight %), an average particle diameter of 90 μm, and containing particles of diameters falling within the average particle diameter±10 μm at a ratio of 78% by volume was deposited by low pressure ambient plasma thermal spraying to form a first layer 12 of an aggregate of coarse particles in a thickness of about 80 μm. The thermal spraying was carried out under the conditions of $6.5\times10^3$ Pa of argon gas ambient pressure, 400 mm of thermal spraying distance, and 34 V 800 A of thermal spraying output.

On the first layer 12 of an aggregate of coarse particles, a coarse alloy powder of the same composition having an average particle diameter of 25 μm and containing particles of diameters falling in the range of the average particle diameter±10 μm at a ratio of 83% by volume was deposited by low pressure ambient plasma thermal spraying to form a second layer 14 of an aggregate of coarse particles in a thickness of about 100 μm. The thermal spraying was carried out under the conditions of $6.5\times10^3$ Pa of argon gas ambient pressure, 400 mm of thermal spraying distance, and 34 V 800 A of thermal spraying output.

Further, on the layer 14 of the aggregate of minute particles, a coarse alloy powder of the same composition having an average particle diameter of 150 μm and containing particles of diameters falling in the range of the average particle diameter±10 μm at a ratio of 75% by volume was deposited by low pressure ambient plasma thermal spraying to form a second layer 13 of an aggregate of coarse particles in a thickness of about 100 μm. The thermal spraying was carried out under the conditions of $6.5\times10^3$ Pa of argon gas ambient pressure, 400 mm of thermal spraying distance, and 36 V 900 A of thermal spraying output.

The first layer 12 of the aggregate of coarse particles, the layer 14 of the aggregate of minute particles, and the second layer 13 of the aggregate of coarse particles jointly formed the metallic bonding layer 15 of three-layer construction. Incidentally, the particles forming the layers 12, 14, and 13 of the aggregates were invariably in a flat shape. By the reduction of particle diameter mentioned above, they were confirmed to have a substantially same average particle diameter as the alloy powder used as the starting material.

Then, on the second layer 13 of the aggregate of coarse particles, a zirconia powder having a composition of 8 wt % $Y_2O_3$-$ZrO_2$ was deposited by atmospheric plasma thermal spraying under the conditions of 125 mm of thermal spraying distance, 35 V 850 A of thermal spraying output to form a ceramic coating layer 3 having a thickness of about 300 μm.

The heat-resistant member 11 aimed at was obtained as described above. This heat-resistant member 11 was tested for such properties as will be specifically mentioned hereinbelow. The cross section of the heat-resistant member 11 was observed to determine $R_{max}$ and $R_z$ in the same manner as in Example 1. As a result, the interface between the first layer 12 of the aggregate of coarse particles and the layer 14 of the aggregate of minute particles was found to have 85 μm for $R_{max}$ and 60 μm for $R_z$. The interface between the layer 14 of the aggregate of minute particles and the second layer 13 of the aggregate of coarse particles was found to have 31 μm for $R_{max}$ and 29 μm for $R_z$. The interface between the second layer 13 of the aggregate of coarse particles and the ceramic coating layer 3 was found to have 91 μm for $R_{max}$ and 67 μm for $R_z$.

COMPARATIVE EXAMPLES 1 AND 2

On a metallic substrate (IN738) identical in composition and shape to that of Example 1, a fine Ni—Co—Cr—Al—Y alloy powder of the same composition as that of Example 1 (having an average particle diameter of 25 μm and containing particles of diameters fall within the range of the average particle diameter±10 μm at a ratio of 83% by volume) was exclusively deposited by low pressure ambient plasma thermal spraying to form a metallic bonding layer having a thickness of about 300 μm. Further, on this one-ply metallic bonding layer, a ceramic coating layer was deposited under the same conditions as in Example 1 to complete a heat-resistant member (Comparative Example 1).

A heat-resistant member (Comparative Example 2) possessing a one-ply metallic bonding layer was manufactured by following the procedure mentioned above while forming the metallic bonding layer by subjecting a coarse Ni—Co—Cr—Al—Y alloy powder (having an average particle diameter of 150 μm and containing particles of diameters falling in the range of the average particle diameter±10 μm at a ratio of 73% by volume) exclusively to low pressure ambient plasma thermal spraying.

The heat-resistant members obtained in Examples 1 and 2 and Comparative Examples 1 and 2 were severally tested for thermal impacts. This test was implemented by repeating the procedure of allowing a sample to stand in the open air at 1100° C. for 30 minutes and then allowing the hot sample to cool at room temperature for 30 minutes until the sample was visually confirmed to sustain cracks and film separation. The number of repetitions of the procedure before the observation of the occurrence of cracks and film separation are shown in Table 1.

TABLE 1

| | Number of repetitions of exertion of thermal impact |
|---|---|
| Example 1 | 1784 |
| Example 2 | 1833 |
| Comparative Example 1 | 477 |
| Comparative Example 2 | 755 |

It is clearly noted from the test results given in Table 1 that the heat-resistant member using a metallic bonding layer of two-layer construction composed of a layer of an aggregate of minute particles obtained by the low pressure ambient plasma thermal spraying of a fine powder (Example 1) or a metallic bonding layer of three-layer construction composed of a layer of an aggregate of coarse particles obtained by the low pressure ambient plasma thermal spraying of a coarse powder in addition to the two layers mentioned above (Example 2) is notably improved in terms of the number of repetitions of the exertion of thermal impact before the observation of the occurrence of cracks and film separation as compared with the heat-resistant member using a metallic bonding layer of one-layer construction formed solely of minute particles (Comparative Example 1) or coarse particles (Comparative Example 2)

EXAMPLE 3

A plate of a Ni-based IN738 heat-resistant alloy measuring 30 mm×50 mm×5 mm (thickness) was prepared as a metallic substrate. The surface of this metallic substrate was subjected to sand blast treatment using alumina particles having a particle diameter of about 1 mm.

Then, on the coarsened surface of the metallic substrate, a fine alloy powder of a composition of Ni-23% Co-17% Cr-12% Al-0.5% Y (weight %) having an average particle diameter of 30 μm and containing particles of diameters falling in the range of the average particle diameter±10μm at a ratio of 80% by volume was deposited by low pressure ambient plasma thermal spraying to form a layer of an aggregate of minute particles having a thickness of about 100 μm. The thermal spraying was carried out under the same conditions as in Example 1.

Subsequently, a mixed powder was prepared by mixing the fine alloy powder mentioned above and a coarse alloy powder of the same composition having an average particle diameter of 50 μm and containing particles of diameters falling in the range of the average particle diameter±10 μm at a ratio of 75% by volume, with the mixing ratio at 1:1 by weight, and the mixed powder was subjected to low pressure ambient plasma thermal spraying. In consequence of this low pressure ambient plasma thermal spraying, a layer of a mixed aggregate of minute particles and coarse particles was formed in a thickness of about 100 μm on the layer of the aggregate of minute particles. The thermal spraying was carried out under the same conditions as in the formation of the layer of the aggregate of minute particles.

Further, on the layer of the mixed aggregate of minute particles and coarse particles, the coarse alloy powder mentioned above was deposited by low pressure ambient plasma thermal spraying to form a layer of an aggregate of coarse particles having a thickness of about 100 μm. The thermal spraying was carried out under the same conditions as used in Example 1.

The layer of the aggregate of minute particles, the layer of the mixed aggregate of minute particles and coarse particles, and the layer of the aggregate of coarse particles jointly formed a metallic bonding layer.

Thereafter, on the layer of the aggregate of coarse particles, a zirconia powder of a composition of 8 wt % $Y_2O_3$-$ZrO_2$ was deposited by atmospheric plasma thermal spraying under the same conditions as in Example 1 to form a ceramic coating layer made of Y-stabilized $ZrO_2$ in a thickness of about 200 μm. Thus, the heat-resistant member aimed at was obtained.

EXAMPLE 4

A plate of a Ni-based IN738 heat-resistant alloy measuring 30 mm×50 mm×5 mm was prepared as a metallic substrate. The surface of this metallic substrate was subjected to sand blast treatment using alumina particles having a particle diameter of about 1 mm.

Then, on the coarsened surface of the metallic substrate, a fine alloy powder of a composition of Ni-23% Co-17% Cr-12% Al-0.5% Y (weight %) having an average particle diameter of 25 μm and containing particles of diameters falling in the range of the average particle diameter±10μm at a ratio of 78% by volume was deposited by low pressure ambient plasma thermal spraying to form a layer of an aggregate of minute particles having a thickness of about 70 μm. The thermal spraying was carried out under the same conditions as in Example 1.

Subsequently, a mixed powder was prepared by mixing the fine alloy powder mentioned above and a coarse alloy powder of the same composition having an average particle diameter of 48 μm and containing particles of diameters falling in the range of the average particle diameter±10 μm at a ratio of 76% by volume, with the mixing ratio of the two powders adjusted, and the mixed powder was subjected to low pressure ambient plasma thermal spraying. To be specific, the mixing ratio was gradually changed from 100% of the fine alloy powder immediately on the layer of the aggregate of minute particles to 100% of the coarse alloy powder. In this manner, a layer of a mixed aggregate containing minute particles and coarse particles at the gradually changed mixing ratio was formed in a thickness of about 70 μm. The thermal spraying was carried out under the same conditions as those used for the formation of the layer of the aggregate of minute particles.

Further, on the layer of the mixed aggregate of minute particles and coarse particles, the coarse alloy powder mentioned above was deposited by low pressure ambient plasma thermal spraying to form a layer of an aggregate of coarse particles in a thickness of about 70 μm. The thermal spraying was carried out under the same conditions as in Example 1.

The layer of the aggregate of minute particles, the layer of the mixed aggregate of minute particles and coarse particles, and the layer of the aggregate of coarse particles mentioned above jointly formed a metallic bonding layer.

Thereafter, on the layer of the aggregate of coarse particles, a zirconia powder of a composition of 8 wt % $Y_2O_3$-$ZrO_2$ was deposited by atmospheric plasma thermal spraying under the same conditions as in Example 1 to form a ceramic coating layer made of Y-stabilized $ZrO_2$ in a thickness of about 200 μm. Thus, the heat-resistant member aimed at was obtained.

COMPARATIVE EXAMPLES 3 AND 4

On a metallic substrate (IN738) identical in composition and shape to that of Example 3, a fine Ni—Co—Cr—Al—Y alloy powder having an average particle diameter of 30 μm and containing particles of diameters falling within the range of the average particle diameter±10 μm at a ratio of 80% by volume was exclusively deposited by low pressure ambient plasma thermal spraying to form a metallic bonding layer in a thickness of about 300 μm. Further, on this one-ply metallic bonding layer, a ceramic coating layer was formed under the same conditions as in Example 1 to complete a heat-resistant member (Comparative Example 3).

A heat-resistant member (Comparative Example 4) possessing a one-ply metallic bonding layer was manufactured by following the procedure described above while using a fine Ni—Co—Cr—Al—Y alloy powder having an average particle diameter of 25 μm and containing particles of diameters falling within the range of the average particle diameter±10 μm at a ratio of 78% by volume.

The heat-resistant members obtained in Examples 3 and 4 and Comparative Examples 3 and 4 were tested for thermal impact under the same conditions as those of the example mentioned above. In the test, the heat-resistant member of Example 3 showed no sign of film separation even after 3000 repetitions of the exertion of the thermal impact and the heat-resistant member of Example 4 showed no sign of film separation even after 3500 repetitions of the exertion of the thermal impact. In contrast thereto, the heat-resistant members of Comparative Examples 3 and 4 both produced film separation after 600 repetitions of the exertion of the thermal impact.

The heat-resistant member of this invention possesses a metallic bonding layer which, as clearly demonstrated by the working examples cited above, offers excellent resistance to high temperature oxidation and to high temperature corrosion and exhibits stability to tolerate thermal fatigue and thermal impact. Even when the heat-resistant member is used under a harsh thermal environment, therefore, the thermal barrier coating layer thereof is prevented from sustaining cracks and consequently inducing film separation and the metallic substrate is stably protected against deterioration.

What is claimed is:

1. A heat-resistant member comprising a metallic substrate, a ceramic coating layer covering a surface of said metallic substrate, and a metallic bonding layer interposed between said metallic substrate and said ceramic coating layer and possed of at least a first layer of an aggregate of minute particles having an average particle diameter of from 1 to 44 μm, said first layer being disposed on said metallic substrate side and a second layer of an aggregate of coarse particles having an average particle diameter in the range of from 45 to 300 μm, said second layer being disposed on said ceramic coating layer side.

2. The heat-resistant member according to claim 1, wherein said layer of an aggregate of minute particles possesses a thickness in the range of from 30 to 200 μm and said layer of an aggregate of coarse particles possesses a thickness in the range of from 30 to 300 μm.

3. The heat-resistant member according to claim 1, wherein said layer of an aggregate of minute particles possesses surface roughness such that a maximum height $R_{max}$ of irregularities is in the range of from 30 to 45 μm and a ten point average height $R_z$ of irregularities in the range of from 25 to 35 μm and said layer of an aggregate of coarse particles possesses surface roughness such that a maximum height $R_{max}$ of irregularities is in the range of from 75 to 100 μm and a ten point average height $R_z$ of irregularities in the range of from 56 to 70 μm.

4. The heat-resistant member according to claim 1, wherein a layer of a mixed aggregate of minute particles and coarse particles is interposed between said layer of an aggregate of minute particles and said layer of an aggregate of coarse particles.

5. The heat-resistant member according to claim 4, wherein a mixing ratio of minute particles and coarse particles in said layer of a mixed aggregate is varied either continuously or stepwise so that the ratio of minute particles is high on the side of said layer of an aggregate of minute particles and the ratio of coarse particles is high on the side of said layer of an aggregate of coarse particles.

6. The heat-resistant member according to claim 1, wherein said metallic bonding layer is a sprayed layer of a M—Cr—Al—Y alloy powder, (wherein M stands for at least one element selected from the group consisting of Ni, Co, and Fe).

7. The heat-resistant member according to claim 6, wherein said layer of an aggregate of minute particles is a flame sprayed layer of a fine powder of said M—Cr—Al—Y alloy having an average particle diameter in the range of from 1 to 44 μm and containing particles of diameters falling within the range of said average particle diameter±10 μm at a ratio of at least 70% by volume and said layer of an aggregate of coarse particles is a flame sprayed layer of a coarse powder of said M—Cr—Al—Y alloy having an average particle diameter in the range of from 45 to 300 μm and containing particles of diameters falling within said average particle diameter±20 μm at a ratio of at least 70% by volume.

8. The heat-resistant member according to claim 1, wherein said metallic substrate is formed of a heat-resistant alloy having at least one element selected from among Ni, Co, and Fe as a main component thereof.

9. The heat-resistant member according to claim 1, wherein said ceramic coating layer is formed of a ceramic material having at least one member selected from among partially stabilized $ZrO_2$, SiC, $Si_3N_4$, WC, TiC, $TiO_2$, $Al_2O_3$, CaO, and $SiO_2$ as a main component thereof.

10. A heat-resistant member comprising a metallic substrate, a ceramic coating layer covering a surface of said metallic substrate, and a metallic bonding layer interposed between said metallic substrate and said ceramic coating layer and possessed of at least a first layer of an aggregate of coarse particles having an average particle diameter in the range of from 45 to 300 μm, said first layer being disposed on said metallic substrate side, a second layer of an aggregate of coarse particles having an average particle diameter in the range of from 45 to 300 μm, said second layer being disposed on said ceramic coating layer side, and a third layer of an aggregate of minute particles having an average particle diameter of from 1 to 44 μm, said third layer being interposed between said first layer of an aggregate of coarse particles and said second layer of an aggregate of coarse particles.

11. The heat-resistant member according to claim 10, wherein said layer of an aggregate of minute particles possesses a thickness in the range of from 30 to 200 μm and said first and second layers of an aggregate of coarse particles possess a thickness in the range of from 30 to 300 μm.

12. The heat-resistant member according to claim 10, wherein said layer of an aggregate of minute particles possesses surface roughness such that a maximum height $R_{max}$ of irregularities is in the range of from 30 to 45 μm and a ten point average height $R_z$ of irregularities in the range of from 25 to 35 μm and said first and second layers of an aggregate of coarse particles possess surface roughness such that a maximum height $R_{max}$ of irregularities is in the range of from 75 to 100 μm and a ten point average height $R_z$ of irregularities in the range of from 56 to 70 μm.

13. The heat-resistant member according to claim 10, wherein a layer of a mixed aggregate of minute particles and coarse particles is interposed at least one between said first layer of an aggregate of coarse particles and said layer of an aggregate of minute particles and between said second layer of an aggregate of coarse particles and said layer of an aggregate of minute particles.

14. The heat-resistant member according to claim 13, wherein a mixing ratio of minute particles and coarse particles in said layer of a mixed aggregate is varied either continuously or stepwise so that the ratio of minute particles is high on the side of said layer of an aggregate of minute particles and the ratio of coarse particles is high on the side of said layer of an aggregate of coarse particles.

15. The heat-resistant member according to claim 10, wherein said metallic bonding layer is a sprayed layer of a M—Cr—Al—Y alloy powder, (wherein M stands for at least one element selected from the group consisting of Ni, Co, and Fe).

16. The heat-resistant member according to claim 15, wherein said layer of an aggregate of minute particles is a sprayed layer of a fine powder of said M—Cr—Al—Y alloy having an average particle diameter in the range of from 1 to 44 μm and containing particles of diameters falling within the range of said average particle diameter±10 μm at a ratio of at least 70% by volume and said first and second layers of an aggregate of coarse particles are sprayed layers of a coarse powder of said M—Cr—Al—Y alloy having an average particle diameter in the range of from 45 to 300 μm and containing particles of diameters falling within said average particle diameter±20 μm at a ratio of at least 70% by volume.

17. The heat-resistant member according to claim 10, wherein said metallic substrate is formed of a heat-resistant alloy having at least one element selected from among Ni, Co, and Fe as a main component thereof.

18. The heat-resistant member according to claim 10, wherein said ceramic coating layer is formed of a ceramic material having at least one member selected from among partially stabilized $ZrO_2$, SiC, $Si_3N_4$, WC, TiC, $TiO_2$, $Al_2O_3$, CaO, and $SiO_2$ as a main component thereof.

19. A heat-resistant member comprising a metallic substrate, a ceramic coating layer covering a surface of said metallic substrate, and a metallic bonding layer interposed between said metallic substrate and said ceramic coating layer, said metallic bonding layer comprising at least a layer of an aggregate of minute particles disposed on said metallic substrate side and at least a layer of an aggregate of coarse particles disposed on said ceramic coating layer side, said metallic bonding layer consisting essentially of a M—Cr—Al—Y alloy, where M stands for an element selected from the group consisting of Ni, Co, and Fe.

20. A heat-resistant member comprising a metallic substrate, a ceramic coating layer covering a surface of said metallic substrate, and a metallic bonding layer interposed between said metallic substrate and said ceramic coating layer, wherein said metallic bonding layer comprises:

at least a first layer of an aggregate of coarse particles disposed on said metallic substrate side and a second layer of an aggregate of coarse particles disposed on said ceramic coating layer side, and a layer of an aggregate of minute particles interposed between said first layer of an aggregate of coarse particles and a second layer of an aggregate of coarse particles, said metallic bonding layer consisting essentially of a M—Cr—Al—Y alloy, where M stands for an element selected from the group consisting of Ni, Co, and Fe.

* * * * *

UNITED STATES PATENT AND TRADEMARK OFFICE

CERTIFICATE OF CORRECTION

PATENT NO. : 5,579,534

DATED : November 26, 1996

INVENTOR(S) : Masayuki ITOH et al.

It is certified that error appears in the above-indentified patent and that said Letters Patent is hereby corrected as shown below:

Claim 1, column 14, line 16, "possed" should read --possessed--.

Signed and Sealed this

Twenty-ninth Day of April, 1997

*Attest:*

*Attesting Officer*

BRUCE LEHMAN

*Commissioner of Patents and Trademarks*